US005330211A

United States Patent [19]

Nicholson

[11] Patent Number: 5,330,211

[45] Date of Patent: Jul. 19, 1994

[54] MECHANIC'S CREEPER

[76] Inventor: Michael A. Nicholson, Route 1, Box 255, Littleton, N.C. 27850

[21] Appl. No.: 760,189

[22] Filed: Sep. 16, 1991

[51] Int. Cl.[5] ..... B25H 5/00

[52] U.S. Cl. ..... 280/32.6

[58] Field of Search ..... 280/32.6, 32.5, 79.11

[56] References Cited

U.S. PATENT DOCUMENTS

| | | | |
|---|---|---|---|
| 1,363,023 | 12/1920 | Taylor | 280/32.6 |
| 1,668,379 | 5/1928 | Radvanyi | 280/32.6 |
| 2,168,455 | 8/1939 | Smith | 280/32.6 |
| 2,487,746 | 11/1949 | Happ | 280/32.6 |
| 2,636,705 | 4/1953 | Stanton | 280/32.6 X |
| 2,689,744 | 9/1954 | Mullin | 280/32.6 |
| 2,861,279 | 11/1958 | Myers | 280/32.6 X |
| 3,677,569 | 7/1972 | Larson | 280/32.6 |
| 4,185,846 | 1/1980 | Black | 280/32.6 |

OTHER PUBLICATIONS

Motor, Jun. 1948, Little Joe, p. 32.

Motor, Jun. 1948, Jeeper Seat, p. 154.

*Primary Examiner*—Joseph D. Pape

*Attorney, Agent, or Firm*—Rhodes, Coats & Bennett

[57] ABSTRACT

A creeper comprising a main panel and wheels is further equipped with storage drawers, an alarm signal, an adjustable lamp, an extendable panel, and an adjustable head rest. The storage drawers are disposed underneath the main panel so that they are accessible and out of the way. The alarm, also mounted beneath the main panel, may be used to signal an emergency. The extendable panel is slidably mounted on the underside of the main panel and may be pulled out from the foot end of the creeper to effectively extend the length of the same. The lamp is mounted on a flexible neck which attaches to the underside of the main panel so that the lamp may also be stored out of the way or directed as desired. The head rest is mounted to the head end of the creeper by hinges and may be positioned in an operative position or a stored position.

9 Claims, 2 Drawing Sheets

MECHANIC'S CREEPER

FIELD OF THE INVENTION

The present invention relates to creepers and more particularly to a creeper having added utilization improvements.

BACKGROUND OF THE INVENTION

Creepers are used by virtually every professional automobile mechanic to access the underside of automobiles. Present creepers consist of a flat rectangular panel large enough to support a man's upper torso and head and small wheels attached to the underside of the panel. The wheels are relatively small and mounted closely to the panel so that the creeper height is only a few inches above the ground. A user may lay on the creeper on his back and then easily roll and maneuver under an automobile.

When underneath the automobile, a mechanic has very limited mobility even with the benefit of the creeper. He must place his tools at the perimeter of the automobile or on his stomach so that they will not be in the way of the creeper wheels. Each time he needs a tool he must maneuver over to where it is. There exists a need for a creeper which would allow a user to have quick and easy access to his tools.

When working underneath an automobile it is also necessary to have light. Like tools, flashlights and corded lights must be kept out of the path of the creeper. Furthermore, mechanics are often unable to hold a light and perform operations on the automobile at the same time. There exists a need for a light source which does not have to be held and which will not interfere with movement of the creeper.

Laying on a hard, flat panel tends to be uncomfortable to a user's head. Often, a mechanic must keep his head raised to see the area he is working on. Therefore, there is a need for a creeper equipped with a headrest. However, there are instances in which the underside of the car will not provide clearance for the head when raised. Therefore, there exists a need for a headrest which may be easily and conveniently disengaged.

Conventional creepers are designed to support only a user's back. Mechanics often lay on creepers for extended periods of time, resulting in severe discomfort to the lower back. There is a need for a creeper which provides support to the buttocks and upper legs so that stress on the lower back is reduced.

The underside of a car is cramped and difficult to move in even with the benefit of a creeper. Should an accident occur, a mechanic is somewhat confined and may be helpless to get himself out from under the automobile. There exists a need for a creeper equipped with an alarm with which a mechanic working beneath an automobile can signal an emergency.

Underneath the automobile is not the only place where convenient maneuverability is desired. A person doing body work or repairs under the hood may wish to move from one side of the automobile to the other while sitting. Therefore, there exists a need for a stool or chair structure that can be easily moved and maneuvered while the user is sitting on it.

SUMMARY AND OBJECTS OF THE INVENTION

The present invention is a creeper which provides efficient and inexpensive solutions for all of the aforementioned problems. The present invention is a creeper equipped with several structures that make it more versatile and expand its utility.

The creeper of the present invention includes a pair of drawers mounted beneath the creeper panel. These drawers may be used to store tools or other articles such that they are easily accessible by the user without inhibiting the maneuverability of the creeper.

The creeper of the present invention includes an adjustable lamp attached to the underside of the panel which can be focused on a desired work surface without the need for other support and which does not impede the movement of the creeper.

The creeper of the present invention further includes a headrest mounted to the underside of the panel which may be positioned on top of the panel such that a user may lay his head on it or it may be positioned underneath the panel and out of the way.

The top side of the panel of the creeper of the present invention includes indentations formed therein. These indentations are adapted to receive and hold the legs of a stool or a chair. A user may convert the creeper into a rolling chair with all of the above mentioned features simply by placing a chair or stool on the panel.

The creeper includes an extendable panel slidably mounted beneath the main panel. This panel may be pulled out to effectively extend the length of the creeper and thereby provide support for the user's buttocks and upper legs which in turn reduces stress on the lower back.

It is an object of the present invention to provide a creeper which has easily accessible storage space which will not interfere with the maneuverability of the creeper.

It is an object of the present invention to provide a creeper which may be effectively extended in length, thus providing support for a user's buttocks and upper legs.

It is an object of the present invention to provide adjustable lamps which may be directed to illuminate a desired area but which will not interfere with the maneuverability of the creeper.

It is an object of the present invention to provide a creeper with alarm means so that a user may easily signal an emergency.

It is an object of the present invention to provide a creeper which may be convened to a rolling stool.

It is an object of the present invention to provide a creeper having an adjustable head rest mounted such that the head rest may be positioned for support of the head when desired and positioned out of the way when not needed.

It is a further object of the present invention to provide a creeper of the character referred to above which retains all the advantages and maneuverability of conventional creepers.

Other objects and advantages of the present invention will become apparent and obvious from a study of the following description and the accompanying drawings which are merely illustrative of such invention.

DETAILED DESCRIPTION OF THE INVENTION

Figure 2:
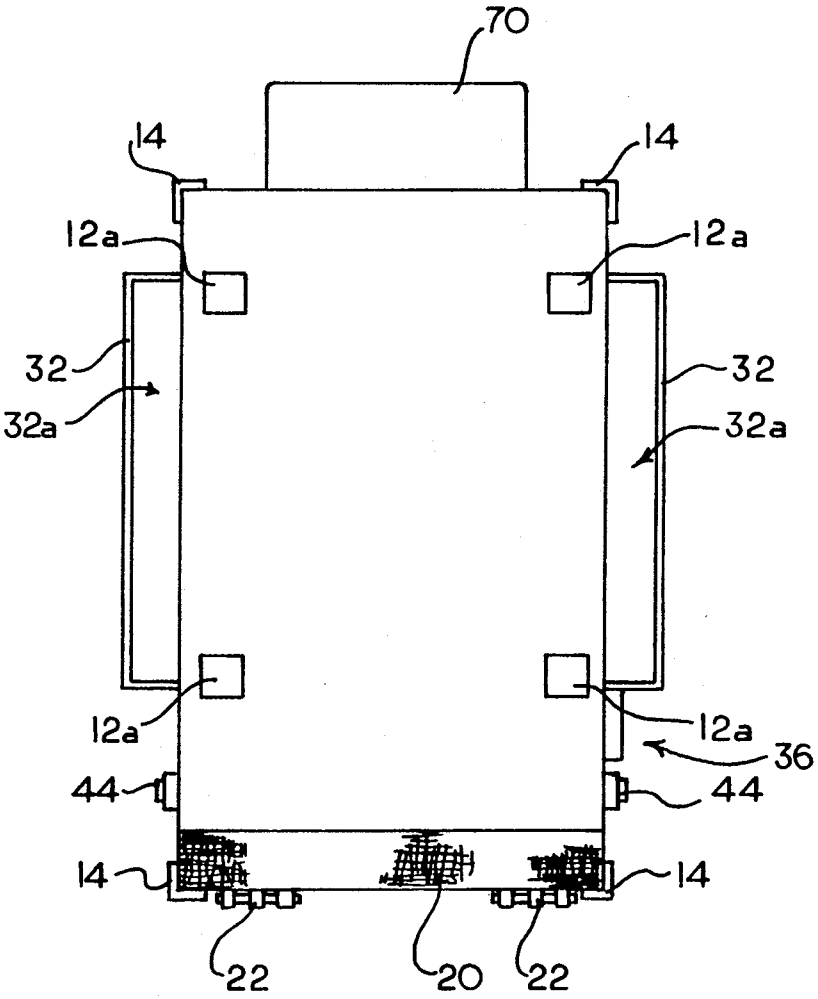
FIG. 2 is a top plan view of the creeper of the present invention.
Figure 1:
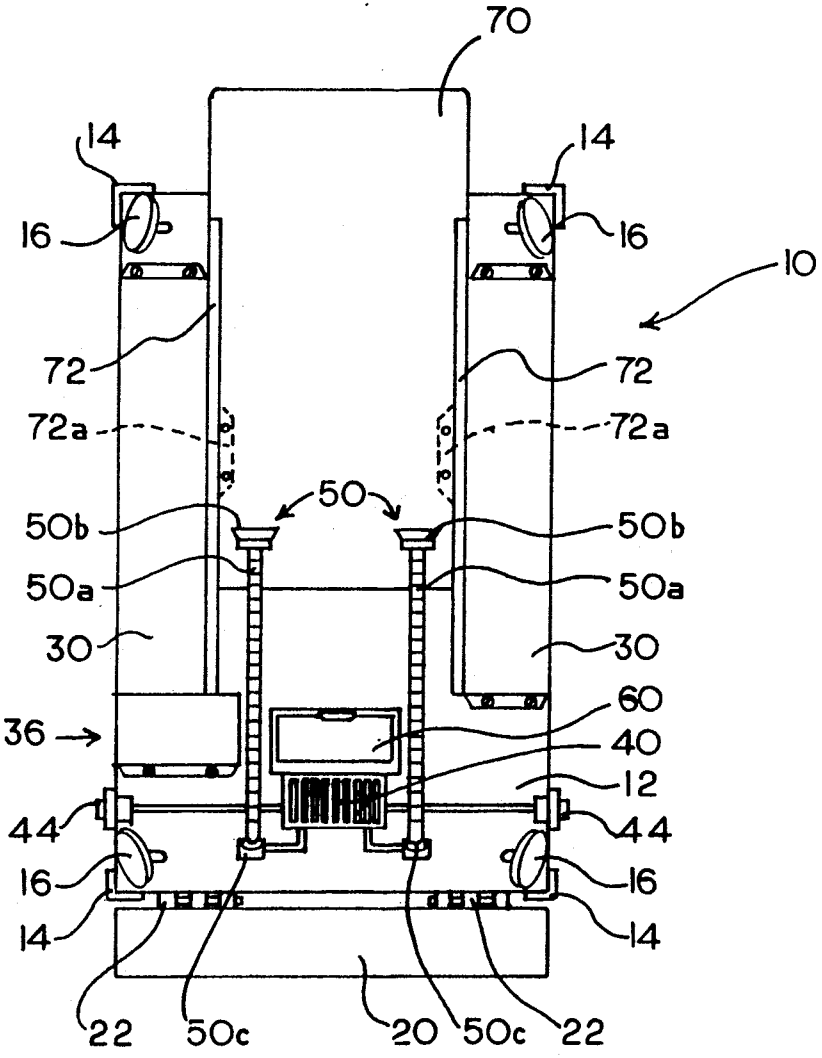
FIG. 1 is a bottom plan view of the creeper of the present invention.

Referring now to the drawings the creeper of the present invention is indicated generally therein by the numeral 10. Creeper 10 may be used with a stool 100 or by itself, depending upon the application.

Basic creeper structure comprises a central or main panel 12 and wheels 16. Panel 12 includes indentations 12*a* formed therein which are adapted to secure the legs of stool 100 as will be discussed hereinafter. Bumper guards 14 are attached to each side corner of panel 12 and serve to protect panel 12 from contact with hard surfaces.

Figure 3:
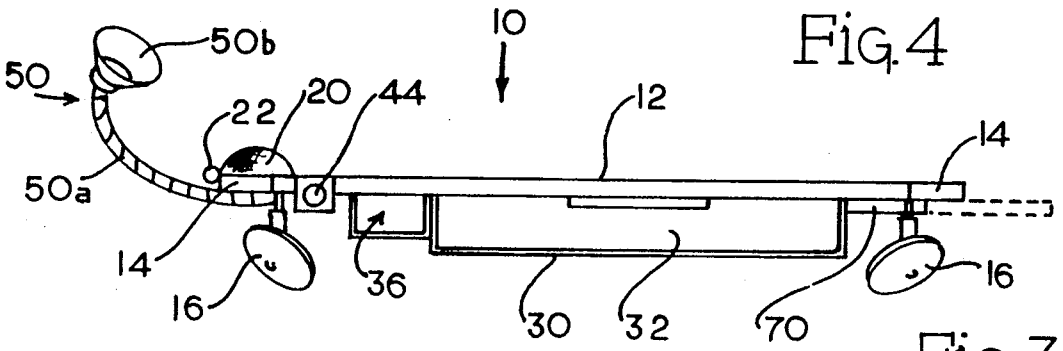
FIG. 3 is a side elevational view of the creeper of the present invention.

An extendable panel 70 is disposed underneath panel 12. Extendable panel 70 is slidably mounted between tracks 72 which are attached to panel 12 by screws at mounts 72 *a*. By sliding extendable panel 70 in tracks 72, the same may be positioned entirely underneath panel 12 (full lines FIG. 3) or it may be partially extended, thereby effectively extending the length of creeper 10. In the extended position, extendable panel 70 provides support for one's buttocks and upper legs and thereby for the user's lower back. This provides support for the user's lower back.

Figure 4:
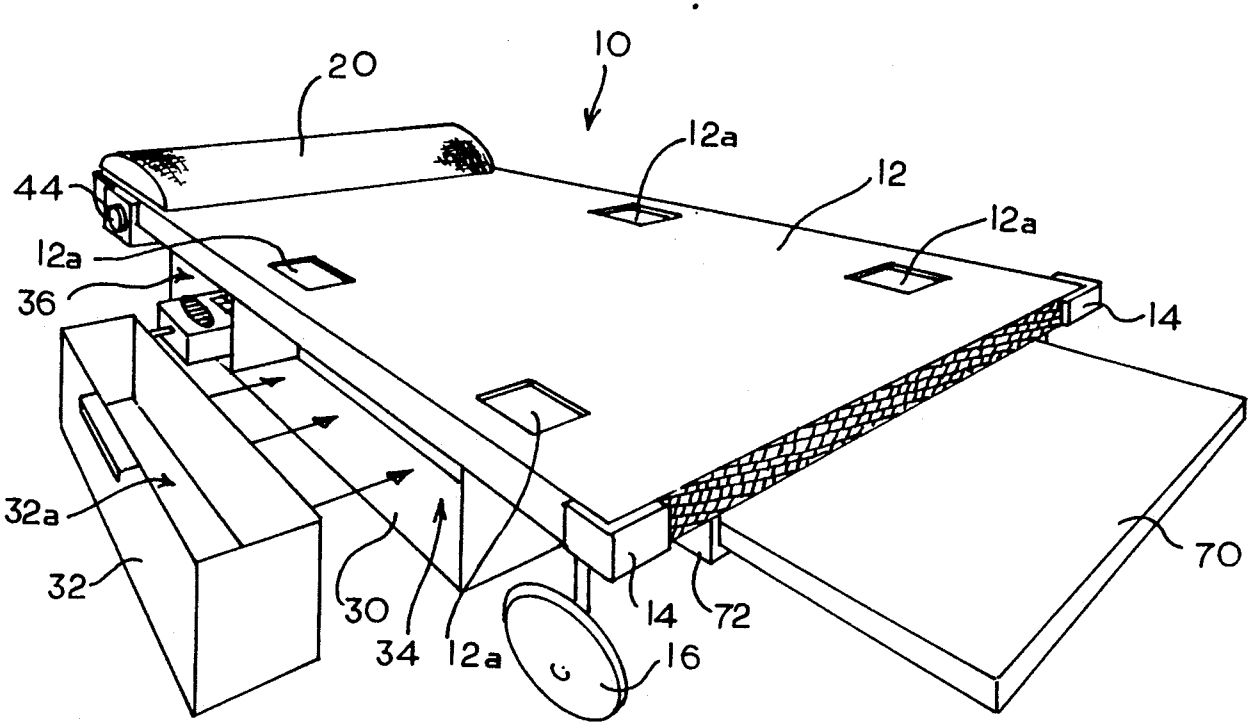
FIG. 4 is a perspective view of the creeper of the present invention wherein the extendable panel is in the extended position, the drawer forming a part of the present invention is removed, and the head rest also forming a part of the present invention is in the operative position.
Figure 5:
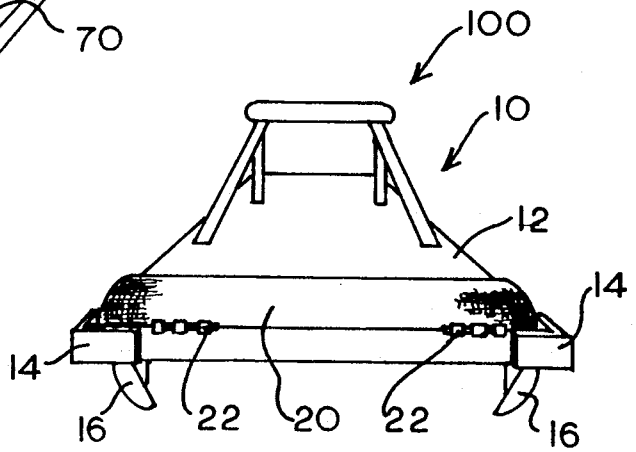
FIG. 5 is a front perspective view of the creeper of the present invention illustrating the creeper supporting a stool.

Drawer frames 30 depend from panel 12 on both sides of tracks 72. Each drawer frame 30 forms a drawer cavity 34 and one drawer frame 30 (FIG. 4) also forms a compartment 36. Compartment 36 is designed to accommodate small articles such as a cordless phone which would not tend to roll out. Drawer cavities 34 are sized to hold drawers 32 which may slide in and out of the same. When fully inserted into drawer cavities 34, the outer faces of drawers 32 are flush with the side edges of panel 12. When pulled out, drawers 32 project out from panel 12 such that openings 32*a* are exposed so that tools or the like may be deposited or removed therefrom.

Head rest 20 is pivotally mounted to the front edge of panel 12 by hinges 22. Hinges 22 allow head rest 20 to be positioned on top of panel 12 in an operative position or beneath panel 12 in a stored position. Head rest 20 may be repositioned simply by swinging it about hinges 22 and need not be removed when unneeded.

Battery pack 60 depends from panel 12 and provides power to lamps 50 and alarm assembly 40 described hereinafter.

Alarm assembly 40 is electrically connected to battery pack 60 and depends from panel 12. Switches 44 are attached at either side of panel 12 and electrically connected to alarm assembly 40. By actuating either switch 44, alarm assembly 40 can be caused to produce an audible alarm signal.

Lamps 50 are secured to the underside of panel 12 by mounts 50*c* which are located at one end of each flexible neck 50*a*. Located at the opposite end of each flexible neck 50*a* are socket assemblies 50*b*. Lamps 50 are electrically connected to and powered by battery pack 60. Flexible necks 50*a* are designed such that socket assemblies 50*b* may be positioned above panel 12 to direct light onto the desired work surface.

Indentations 12*a* formed in the top side of panel 12 are adapted to hold and stabilize the legs of stool 100. By placing stool 100 in indentations 12*a*, creeper 10 may be converted to a rolling stool.

It is appreciated that the creeper of the present invention has all the advantages of conventional creepers in addition to the above described improvements. The creeper of the present invention is easily maneuverable and provides a directable light source, an emergency alarm, and easily accessible storage space. The creeper of the present invention may be converted to a longer creeper such that it provides additional support or even to a maneuverable stool.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A creeper, comprising:

a) a main panel having an underside, a top side, a front end and a back end;

b) an extendable panel slidably mounted to the underside of the main panel and movable from a retracted position underneath the main panel to an extended position where at least a portion of the extended panel extends outwardly from the main panel;

c) a storage frame depending from the underside of the main panel;

d) a storage drawer disposed within and removable from the storage frame;

e) roller means attached to the underside of the main panel; and (f) alarm means attached to the underside of the main panel for generating an audible signal when actuated.

2. The creeper according to claim 1 further including an adjustable lamp attached to the underside of the main panel.

3. The creeper according to claim 1 further including a head rest structure attached to the front end of the main panel.

4. The creeper according to claim 3 wherein the head rest structure is attached to the front end of the main panel by a hinge means such that it may be moved between an operative position and an inoperative position.

5. The creeper according to claim 1 further including spaced indentations formed in the top side of the main panel adapted to accommodate at least three legs of a stool structure.

6. A creeper adapted to receive and support a stool such that the creeper can be converted to a rolling stool, comprising:

a) a main support panel;

b) wheel means secured to the main support panel; and c) means formed on the top side of the main panel for removeably receiving and holding a stool, said means for receiving and holding the stool including a series of spaced apart indentations formed in the top side of the main panel for removeably receiving and laterally confining the lower ends of at least three stool legs such that the stool can be securely stationed on the creeper.

7. The creeper according to claim 6 further including drawer means mounted on the main panel.

8. The creeper according to claim 6 further including an extendable panel slidably mounted to the underside of the main panel.

9. The creeper according to claim 6 further including a head rest structure attached to the front end of the main panel such that it may be moved between an operative position and an inoperative position.

* * * * *